United States Patent [19]

Bell

[11] Patent Number: 4,630,853

[45] Date of Patent: Dec. 23, 1986

[54] LOCK FOR SLIDING DOORS

[75] Inventor: L. James Bell, Willowdale, Canada

[73] Assignee: O. Ruben Pettersson, Toronto, Canada

[21] Appl. No.: 718,120

[22] Filed: Mar. 29, 1985

[51] Int. Cl.[4] ..... E05C 19/18

[52] U.S. Cl. ..... 292/258; 292/244; 292/DIG. 46

[58] Field of Search ..... 292/60, 62, 67, 69, 292/258, 244, DIG. 46, 288, 289, 292, 290

[56] References Cited

U.S. PATENT DOCUMENTS

| | | | |
|---|---|---|---|
| 1,800,804 | 4/1931 | Nelson | 292/69 |
| 2,564,600 | 8/1951 | Hummer | 292/288 |
| 3,428,349 | 2/1969 | Shelton | 292/288 |
| 3,756,641 | 9/1973 | Dugan | 292/DIG. 46 X |
| 3,929,362 | 12/1975 | Petroff | 292/258 X |
| 3,975,041 | 8/1976 | Edison | 292/DIG. 46 X |
| 4,062,576 | 12/1977 | Jennings et al. | 292/DIG. 46 X |
| 4,105,233 | 8/1978 | Levey | 292/DIG. 46 X |
| 4,148,508 | 4/1979 | Adair | 292/DIG. 46 X |
| 4,330,146 | 5/1982 | Sessions | 292/258 |
| 4,470,231 | 9/1984 | Lewis | 292/69 X |

*Primary Examiner*—Robert L. Wolfe
*Assistant Examiner*—Russell W. Illich
*Attorney, Agent, or Firm*—R. Craig Armstrong

[57] ABSTRACT

An auxiliary locking device for a sliding door is disclosed, comprising a blocking member having an upward-opening longitudinal channel near its inner side for receiving the inner frame member of the sliding door channel. At least one clamping screw protrudes through threaded hole(s) in the inner side of the blocking member into the longitudinal channel, for clamping the blocking member to the inner frame member of the sliding door with the outer portion of the blocking member protruding into the sliding door channel for blocking sliding of the sliding door, thereby preventing opening of the door past the blocking member location. A rod projects from the outer portion of the blocking member for positioning along the sliding door channel above the sliding door when the device is installed, for thereby preventing the sliding door from being lifted out of its channel for removal. The outer portion of the blocking member is provided with an upward-opening channel, and the rod is L-shaped. The rod portion constituting the base of the L-shape extends through a hole passing downwardly through the outer portion of the blocking member in the channel. Spring means are provided between the rod and the blocking member for biasing the rod into the channel, whereby the rod may be lifted from the channel against the spring force to swing the rod to project from the blocking member in either direction of the channel.

1 Claim, 4 Drawing Figures

LOCK FOR SLIDING DOORS

BACKGROUND OF THE INVENTION

This invention relates to security devices, and particularly to an auxiliary locking device for a conventional sliding door.

Security devices are of course much in demand in today's society. Many different devices are on the market, but nevertheless there exists a need for a simple device which can be used by householders as an auxiliary locking device for conventional sliding doors.

SUMMARY OF THE INVENTION

It is an object of the invention to provide a simple device which can be used by householders as an auxiliary locking device for conventional sliding doors.

Thus in accordance with the present invention there is provided an auxiliary locking device for a sliding door, comprising a blocking member having an upward-opening longitudinal channel near its inner side for receiving the inner frame member of the sliding door channel. At least one clamping screw protrudes through threaded hole(s) in the inner side of the blocking member into the longitudinal channel, for clamping the blocking member to the inner frame member of the sliding door with the outer portion of the blocking member protruding into the sliding door channel for blocking sliding of the sliding door, thereby preventing opening of the door past the blocking member location.

In accordance with another feature of the invention, a rod may project from the outer portion of the blocking member for positioning along the sliding door channel above the sliding door when the device is installed, for thereby preventing the sliding door from being lifted out of its channel for removal.

In accordance with another aspect of the invention, the outer portion of the blocking member may be provided with an upward-opening channel, and the rod is L-shaped. The rod portion constituting the base of the L-shape extends through a hole passing downwardly through the outer portion of the blocking member in the channel. Spring means are provided between the rod and the blocking member for biasing the rod into the channel, whereby the rod may be lifted from the channel against the spring force to swing the rod to project from the blocking member in either direction of the channel.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
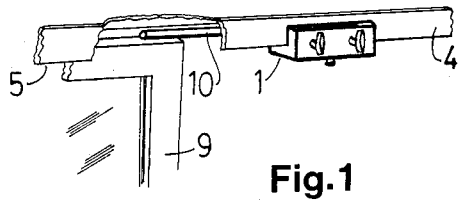
FIG. 1 is an illustration showing the preferred embodiment of the invention installed on a sliding door frame.
Figure 2:
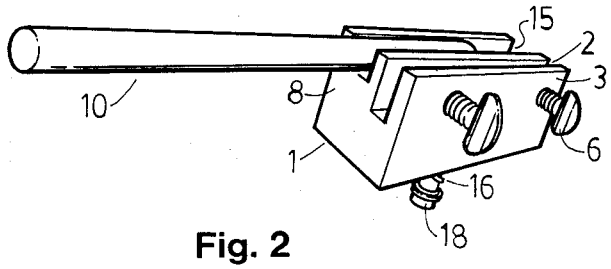
FIG. 2 is an oblique drawing of the device.
Figure 3:
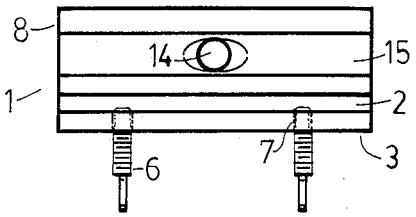
FIG. 3 is a top view of the device.
Figure 4:
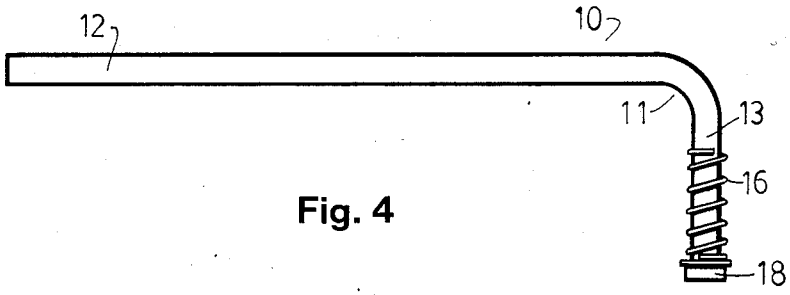
FIG. 4 is an illustration of the L-shaped rod in the preferred embodiment.

The locking device of the present invention consists essentially of a blocking member 1 having an upward opening longitudinal channel 2 near its inner side 3 for receiving the inner frame member 4 of a sliding door channel 5. Two clamping screws 6 protrude through threaded holes 7 in the inner side of the blocking member into the longitudinal channel 2, for clamping the blocking member to the inner frame member 4 with the outer portion 8 of the blocking member 1 protruding into the sliding door channel to block the sliding of the sliding door 9, thereby preventing opening of the door past the blocking member location.

A rod 10 projects from the outer portion of the blocking member for positioning along the sliding door channel 5 above the sliding door 9. The rod is L-shaped, with the long arm 12 of the L-shape extending above the sliding door, and the short arm 13 of the L-shape projecting down through a hole 14 in an upward-opening channel 15 running longitudinally along the outer portion 8 of the blocking member. The long arm 12 of the rod rides in this channel. The hole 14 is countersunk to accommodate the inner radius 11 of the rod 10. A cap 18 is pressed onto the end of the short arm 13, and a light spring 16 is installed between the cap and bottom of the blocking member 1, thereby biasing the long arm 12 of the rod into the channel 15. The rod may be lifted from the channel 15 against the spring force to swing the rod in the other direction in order to adapt to doors sliding either from right to left or from left to right.

Because the rod 10 extends above the sliding door 9, the sliding door cannot be lifted out of its frame to remove the door and gain access. The rod extends out approximately six inches or thereabouts from the blocking member, so that the blocking member may be positioned up to six inches away from the closed sliding door location. Thus the sliding door may be opened up to six inches for ventilation or small pet access, while still ensuring maximum security.

As can be readily appreciated, the device is extremely simple to install, with no tools being required, and no drilling or cutting required.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. An auxiliary locking device (as recited in claim 2,) for a sliding door, comprising:

a blocking member having an upward-opening longitudinal channel near its inner side for receiving the inner frame member of the sliding door channel;

at least one clamping screw protruding through threaded hole(s) in the inner side of said blocking member into said longitudinal channel, for clamping said blocking member to said inner frame member of said sliding door with the outer portion of said blocking member protruding into the sliding door channel for blocking sliding of said sliding door, thereby preventing opening of the door past the blocking member location;

a rod projecting from the outer portion of said blocking member for positioning along said sliding door channel above said sliding door when said device is installed, for thereby preventing said sliding door from being lifted out of its channel for removal;

in which said outer portion of said blocking member is provided with an upward-opening channel, in which said rod is L-shaped, in which the rod portion constituting the base of said L-shape extends through a hole passing downwardly through said outer portion of said blocking member in said channel, and in which spring means are provided between said rod and said blocking member for biasing said rod into said channel, whereby said rod may be lifted from said channel against said spring force to swing said rod to project from said blocking member in either direction of said channel.

* * * * *